United States Patent [19]

Donato

[11] 4,181,388

[45] Jan. 1, 1980

[54] TAP MEMBER WITH AXIALLY ADJUSTABLE CONTACT FOR MULTI-CONDUCTOR ELECTRICAL TRACK

[75] Inventor: Anthony C. Donato, Westfield, N.J.

[73] Assignee: Lightolier Incorporated, Jersey City, N.J.

[21] Appl. No.: 933,739

[22] Filed: Aug. 15, 1978

[51] Int. Cl.[2] ..... H01R 41/00; H01R 29/00

[52] U.S. Cl. ..... 339/21 R; 339/31 R

[58] Field of Search ..... 339/21 R, 21 S, 22 R, 339/22 B, 22 T, 31 R, 31 L, 31 M

[56] References Cited

U.S. PATENT DOCUMENTS

| | | | |
|---|---|---|---|
| 3,496,518 | 2/1970 | Neumann et al. | 339/31 R |
| 3,832,503 | 8/1974 | Crane | 339/21 R |

*Primary Examiner*—Neil Abrams

*Attorney, Agent, or Firm*—Arthur B. Colvin

[57] ABSTRACT

The present invention is directed to a tap member for use with a multi-conductor electrical track, e.g. a track having four (4) conductors, namely, three live conduits and a neutral conduit, which tap member is adjustable to enable the same to be connected selectively to any one of the three circuits defined between the live conduits and the neutral conduit.

7 Claims, 8 Drawing Figures

TAP MEMBER WITH AXIALLY ADJUSTABLE CONTACT FOR MULTI-CONDUCTOR ELECTRICAL TRACK

BACKGROUND OF THE INVENTION

1. Field of the Invention

The present invention is in the field of electrical power distribution systems of the type utilizing a power distribution track of the sort which is typically secured to a ceiling or wall, the track including an elongated access channel. Various tapping devices which may be integrated with lamps, spot lights, power take-off sockets or the like may be attached to the track at any position along the length thereof to draw power therefrom.

2. The Prior Art

Numerous power distribution track systems are known, which track systems enable connection to the mains, of a series of lamps, spot lights or like appliances by the insertion of a tapping member at any position along the length of the track. By way of illustration, reference is made to U.S. Pat. No. 3,496,518 wherein there is disclosed an elongated track having a downwardly or outwardly facing open channel providing access to the interior of the track. Within the track there is disposed an insulative sheath carrying a plurality of longitudinally extending conduits. A tapping member is disclosed which may be mounted to the track, the movable mounting mechanism carrying contacts which are shifted into engagement with the conduits, preferably in the course of mechanically mounting the tapping mechanism to the track.

Currently, power distribution tracks are provided with a multiplicity of conduits, enabling the same track to carry, by way of example, three separate circuits. Such devices include a neutral conduit and three live conduits. Heretofore, in such multi-circuit power distribution tracks it has been necessary for the distribution or electrical contractor to stock a plurality of different tapping mechanisms, each such mechanism being adapted to be installed in the track in such manner that the connection is effected to a particular desired circuit. Obviously, the requirement of providing multiple types of power take off devices complicates the stocking problems of the contractor or supplier and reduces the flexibility of the system to the user.

SUMMARY

The present invention may be summarized as directed to an improved power take off or tap mechanism for use with multi-circuit power distribution tracks, the tapping mechanism being characterized by a novel construction which enables the tap to be adjusted selectively to effect connection to any one of the circuits embodied in the track.

The tapping mechanism includes a lock mechanism, known per se, which, when rotated, effects mechanical connection to the track. A spindle is coupled to the lock mechanism, which spindle carries two contacts, namely, a first fixed contact which is positioned always to engage the neutral conduit of the track on locking of the tap mechanism, and a live contact member which is movably mounted to the spindle such that the same may be connected to the spindle in any of three discrete positions, which positions are so arranged as to effect contact selectively with any of the other three conduits in the track when the tap is locked in position. The spindle includes an axially extending conductive shaft connected to the live output of the tap, the shaft being coincident with the axis of rotation of the spindle. The live contact portion includes a commutator in sliding contact with the shaft.

Complimental detenting means are interposed between the live contact member and the spindle to enable the live contact member selectively to be positioned in one of three discrete orientations relative to the spindle, the detenting means providing for both axial and angular adjustment of the parts.

Accordingly, it is an object of the present invention to provide an improved tap assembly which enables contact to be effected to any of a plurality of circuits contained within a power distribution track selectively in accordance with the adjusted position of parts of the tap assembly.

A further object of the invention is the provision of a tap assembly of the type described wherein activation of the mechanism which mechanically connects the tap and track also effects connection to the desired circuit.

A further object of the invention is the provision of a device of the type described wherein the tap includes a neutral contact which will always engage the neutral conduit and a movable live contact which may be adjusted axially and angularly relative to the spindle selectively in accordance with the circuit to which contact is to be made.

Still a further object of the invention is the provision of a device of the type described wherein the spindle includes, in addition, an axially directed slideway and the live contact includes an exterior surface shiftable within said slideway, the slideway and the exterior surface providing a keyed, torque-transmission relation whereby the live contact and spindle may be both axially adjusted and angularly adjusted relative to each other.

To attain these objects and such further objects as may appear herein or be hereinafter pointed out, reference is made to the accompaning drawings, forming a part hereof, in which.

Figure 1:
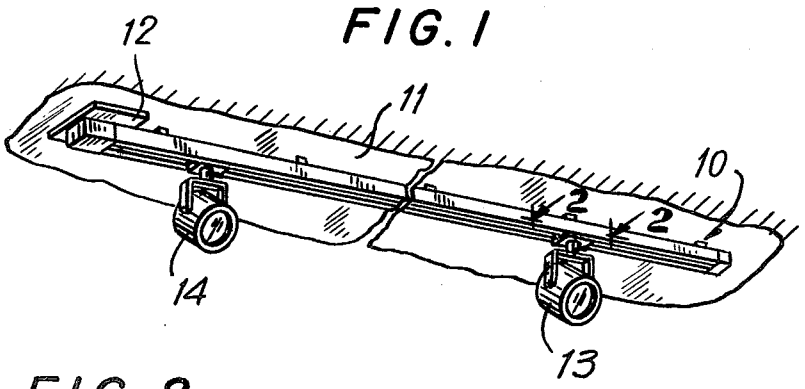
FIG. 1 is a perspective view of a typical power track installation.
Figure 2:
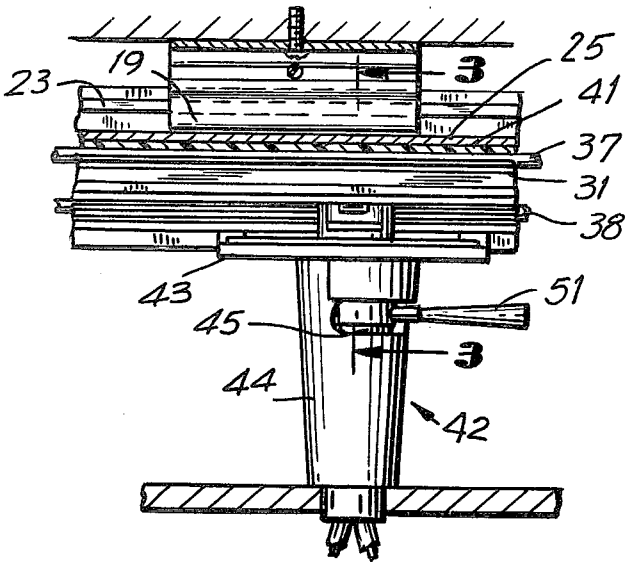
FIG. 2 is a magnified sectional view taken on the line 2—2 of FIG. 1.

Referring now to the drawings, there is shown in FIG. 1 an electrical power distribution track 10 fixed to a ceiling or overhead structure 11. Electrical connection to the conduits whith the track 10 may be effected through a junction box 12. Additionally, there are shown mounted to the track a pair of spotlights 13, 14, it being understood that the specific appliance, namely, the spotlight, is illustrated by way of example only of a type of electrical apparatus which may be used advantageously in conjunction with the track.

The power track 10, which is known per se, may include an elongate extrusion 15 including an upwardly facing mounting channel 16 and a downwardly facing channel or chamber 17 housing the electrical conduits. Mounting of the extrusion 15 may be effected by bracket assembly 18 made fast to the ceiling, the bracket assembly including depending legs 19, 20 having arcuate receiver portions 21, 22 within which inturned ribs 23, 24 of the extrusion lie.

The downwardly directed channel 17 includes an upper web 25, depending side walls 26, 27 and inturned retainer lips 28, 29. An elongated vinyl or like nonconductive extrusion 30 is received in the chamber 17. The extrusion 30 includes inwardly directed projections 31, 32, 33, 34, 35, 36, providing support for the conduits 37, 38, 39 and 40.

Figure 3:
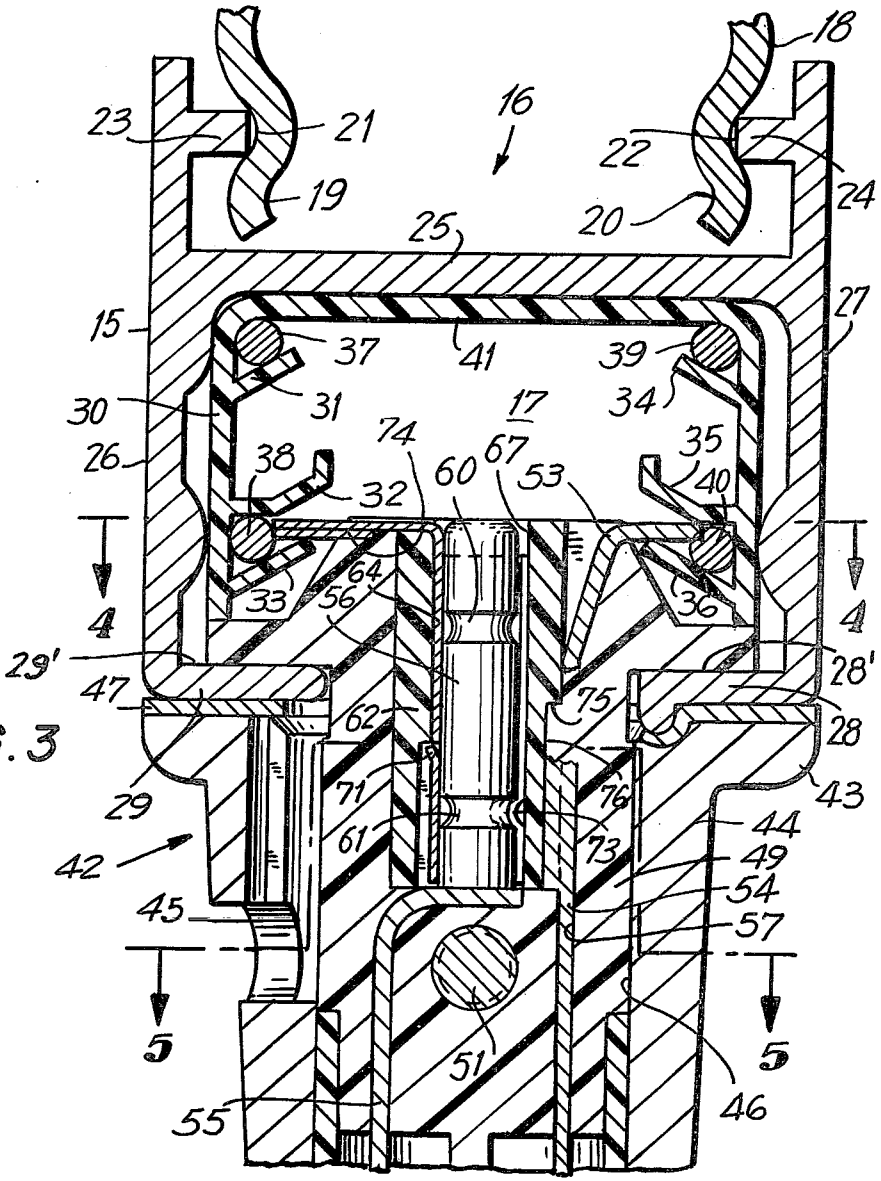
FIG. 3 is a further magnified vertical section taken on the line 3—3 of FIG. 2.

As will be appreciated from an inspection of FIG. 3, the conduits 37 and 39 are pressed against upper wall 41 by the projections 31 and 34, respectively. In similar fashion, conduit 38 is supported between projections 32 and 33, and conduit 40 between projections 35 and 36.

It will further be observed that each of the conduits is accessible in a transverse outward direction for engagement with the conductor components of the tapping assembly. As thus far described, the track assembly and method of mounting same is essentially conventional.

The tapping apparatus which is the subject of the present invention is comprised of a housing member 42 having a base plate 43, the base plate having a depending bearing portion 44. The bearing portion 44 includes a radially directed arcuate slot 45 and an internal bore 46. A cushioning layer 47 may be disposed on the upper surface of the base plate 43.

Figure 6:
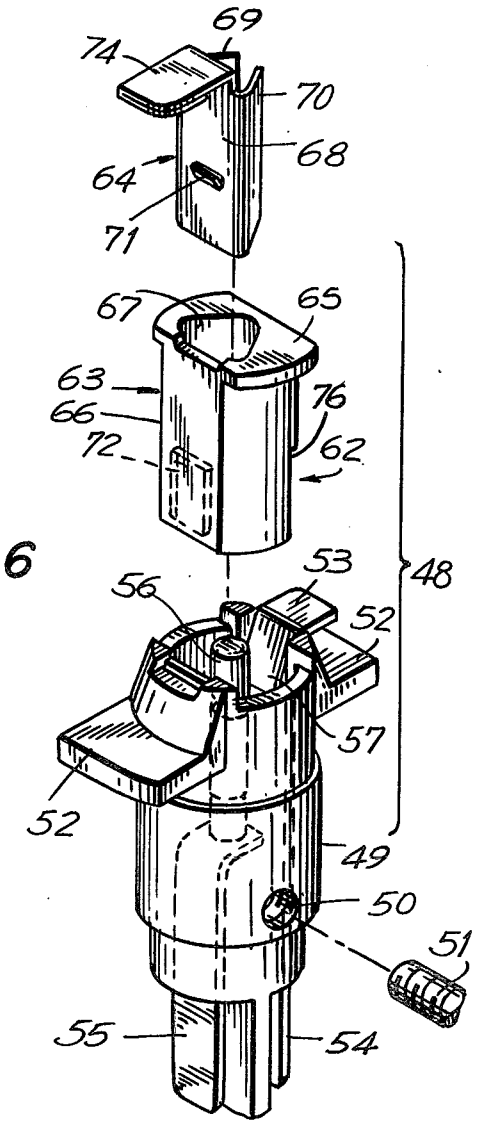
FIG. 6 is an exploded perspective view of components of the contact portions of the tapping assembly.

Housed within the bearing portion 44 is a spindle assembly 48 depicted in FIG. 6. The spindle assembly, which is preferably formed of polycarbonate plastic or like rigid insulating polymeric material, includes a spindle 49 rotatably mounted in the bearing portion 44. The spindle 49 includes a transversely directed retainer aperture 50 which is internally threaded to receive an actuating lever 51.

It will be appreciated that the spindle portion is retained in position within the bearing portion 44 by sleeving the same downwardly into the interior of the bearing portion until the aperture 50 aligns with the arcuate slot 45, and thereafter threading the innermost end of the operating lever 51 into said aperture.

The spindle 49 includes a pair of transversely directed clamp wings 52, 52, the transverse extent of which is such as to permit the wings to be inserted into the interior of the channel 17 through the space provided between lips 28, 29 with the wings aligned parallel to the channel. When thus positioned, and with the base 43 pressed against the outer face of the lips, the operating lever 51 may be rotated through 90°, whereupon the wings 52 will be shifted to overlie the inner surfaces 28', 29' of the lips, securely clamping the base to the track.

As shown, the base may include upwardly directed projections entering partially into the channel, securely to lock the tap assembly against torsional movements relative to the channel.

As thus far described, the locking mechanism is known per se and, accordingly, further elaboration thereof need not here be undertaken.

The principal advance of the present invention concerns itself with the spindle assembly 48, which, as readily recognized from FIG. 6, is formed of a multipart construction, enabling the same to be used selectively to tap or derive power from any one of the three circuits provided by the four conduits 37, 38, 39 and 40.

Figure 8:
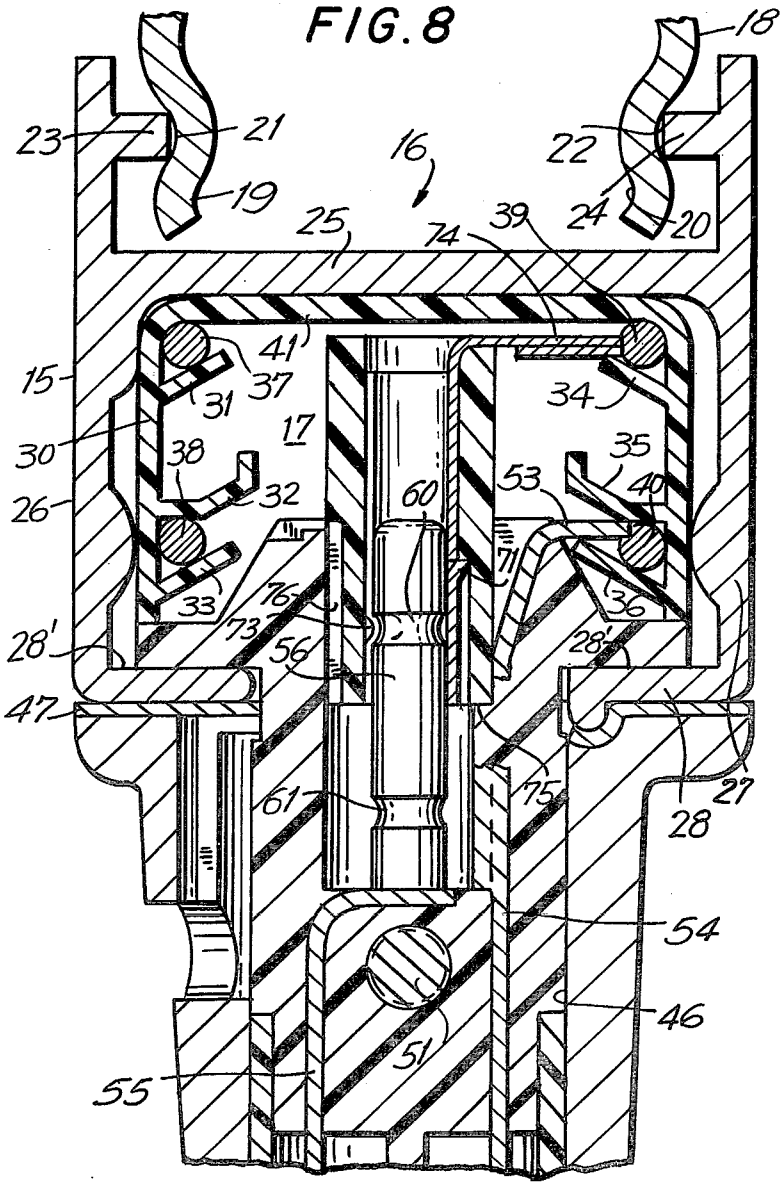
FIGS. 7 and 8 are views similar to FIG. 3 showing the position of the parts of the tapping assembly making contact with alternate circuits.

For purposes of the present description, it may be assumed that the conduit 40 defines a neutral conduit and forms the common component with any of the three other conduits. To this end, the spindle 49 includes a first or neutral contact 53 which, when the spindle is rotated to the locked position of FIGS. 3, 7 or 8, will bear against neutral conduit 40. The contact 53 includes a depending neutral conductor member 54 which may be connected to a wire leading to the fixture to be powered.

The spindle 49 includes a second conductor 55 connected at its lower end to the opposite pole or terminal wire of the fixture, the upper end of the conductor 55 carrying an upstanding conductor shaft 56 insulated from the conductor by the material of the spindle.

The shaft 56 is disposed within a vertically extending slideway 57 in the nature of a bore formed within the spindle. The slideway is of symmetrical configuration and may optionally but preferably be in the form of a circle having flattened side walls 58, 59 -- see FIG. 5. The shaft member 56 includes a pair of annular, recessed, vertically spaced-apart rings or grooves 60, 61, the rings or grooves, as will be more clearly apparent, functioning as an element or component of detent means.

The slideway 57 provides a housing for adjustably receiving the live contact assembly 62. The live contact assembly is comprised of an insulated carrier member 63 and a contact component 64. The carrier member 63 includes a beaded end portion 65 and a shank portion 66 having a cross-sectional configuration matching the internal configuration of the slideway enabling the same to be slidably received for axial movement within the slideway 57 of the spindle 49 in either of two positions 180° apart.

The contact component 64 is mounted within an axially extending shaped bore 67 within the live contact assembly 62. The component 64, which is formed of conductive yet highly resilient material such as phosphor bronze or the like, includes a back portion 68 and a converging pair of legs 69, 70. A retainer dart or tang 71 is stamped from the back portion 68 of the contact. The tang functions, when the contact is slid into the bore 67 of the carrier 62, to enter behind a retainer shoulder 72 adjoining the bore 67, whereupon the contact, once sleeved into the bore, cannot thereafter be withdrawn.

Figure 4:
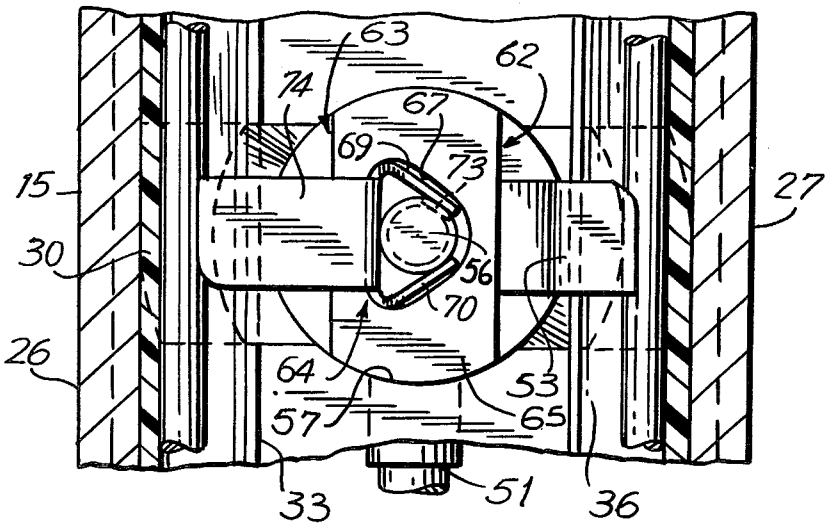
FIG. 4 is a horizontal section taken on the line 4—4 of FIG. 3.
Figure 5:
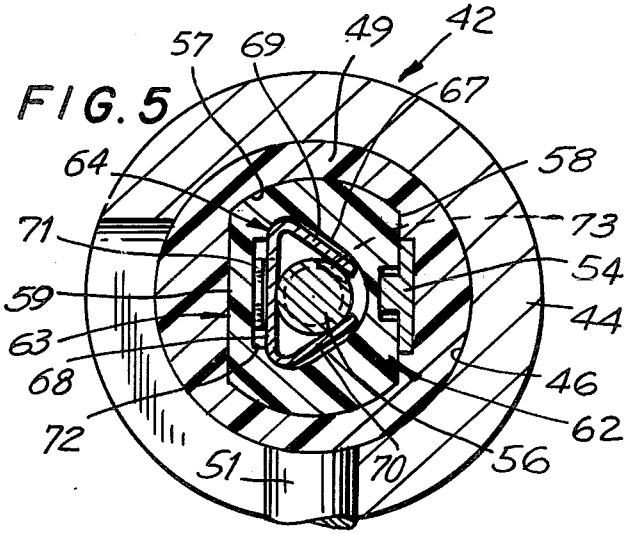
FIG. 5 is a horizontal section taken on the line 5—5 of FIG. 3.

The leg 69 of the contact includes an inwardly deflected tang 73 -- see FIGS. 4 and 5, which tang functions to cooperate with the annular grooves or rings 60, 61 of the shaft 56 to act as a detent whereby the carrier and contact may be supported along the shaft at either of two axially spaced positions, depending upon which of the grooves 60 or 61 is in registry with the tang or detent, 73.

The legs 69, 70 of the contact 64, when positioned over the shaft 56, are deflected or distended from their unstressed position so as to provide a tight sliding engagement with the shaft, with consequent excellent electrical contact between the noted components.

The operation of the device will be evident from the preceding description.

Figure 7:
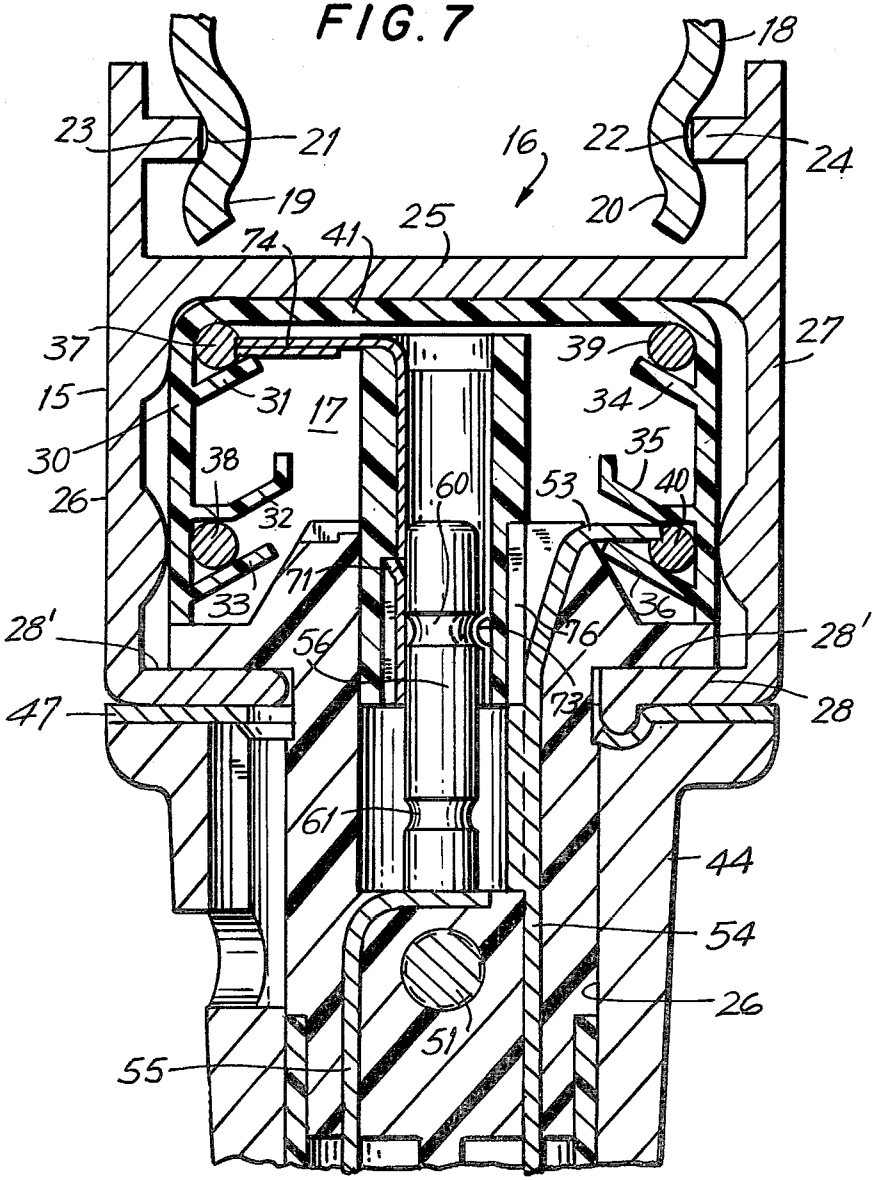

Should the user desire to derive connection from the circuit connected to line 37, the live contact carrier 62 is sleeved into the bore 57 of the spindle in such manner that the tang 73 enters into the upper groove 60 and the circuit contact wing 74 is projected in a direction opposite to neutral contact 53. With the parts thus assembled, as shown in FIG. 7, when the operating lever 51 is rotated to the locked position, the live contact wing 74 will engage conduit 37 and the neutral contact will engage the neutral conduit 40.

If the circuit to be tapped is desirably comprised of the conduit 38 and neutral conduit 40, the carrier 62 is merely depressed to the position shown in FIG. 3 whereat, upon rotation of the spindle to the locked position, the desired components are incorporated into the electrical circuit.

Where it is desired to effect contact between the main contact 39 and the neutral conduit 40, the contact carrier 62 is lifted outwardly from the bore 57 in the spindle, rotated through 180°, and thereafter reinserted into the bore.

Optionally, but preferably, means are provided to assure that the carrier 62 and live contact 64 cannot be depressed to the lower position. By way of example, such means may include an axially directed stop shoulder 75 projecting into the bore 57 of the spindle. The upper end of the shoulder 75 will act to stop downward movement of the insert beyond the desired position. To permit the carrier 62 to be depressed to the position of FIG. 3, the side surface of the same is provided with an axially directed recess 76 which sleeves over the shoulder 75, permitting the same to be depressed to the lower position shown in FIG. 3 only when the shoulder and recess are aligned.

From the foregoing it will be recognized that there is provided in accordance with the present invention a tap mechanism which may be manipulated to derive power from any of a plurality of circuits in a power distribution track member. While the device has been illustrated in conjunction with a track having four (4) conduits defining three (3) circuits it may be readily adapted for use with tracks having more or less conduits.

Accordingly, the invention is to be broadly construed within the scope of the appended claims.

Having thus described my invention, what I claim as new and desire to secure by Letters Patents of the United States is:

1. A universal tap member adaptable for drawing power from one of three separate main circuits carried by an electric power distribution track of generally inverted U configuration, said track having a downwardly open channel and including insulation means carrying first and second vertically and horizontally offset pairs of parallel elongate conduits, said tap comprising a base portion adapted to engage against said channel, a bearing member formed on said base portion, a non-conductive spindle rotatably mounted in said bearing member from a first to a second position, a neutral contact member fixedly mounted to said spindle and positioned to engage a selected one of said conduits responsive to rotation of said spindle to said second position, an elongate conductor shaft of regular cross section mounted on said spindle and electrically isolated from said neutral contact, said shaft having its longitudinal axis concident with the axis of rotation of said spindle, a live contact member mounted on said spindle and including a commutator portion slidingly engaging said shaft in electrical contact therewith, said live contact member being shiftable axially of said spindle, complemental stop means interposed between said live contact member and said spindle for supporting said contact means adjustably in one of three discrete positions relative to said shaft, said contact means including a longitudinally directed contact portion electrically connected to said commutator and positioned to engage a selected conduit other than said one conduit in accordance with the adjusted position of said contact member and spindle responsive to rotation of said spindle from said first to said second position.

2. A device in accordance with claim 1 in which locking means are provided on said spindle for engaging and clamping said base to said channel responsive to rotation of said spindle from a first to a second position.

3. A tap member in accordance with claim 1 wherein said spindle includes an upwardly facing, open ended slideway surrounding said shaft, and said live contact member includes a coupler portion insertable endwisely into said slideway in either of two relatively rotated positions with respect thereto.

4. A device in accordance with claim 3 wherein the interior surface of said slideway and the exterior surface of said coupler portion are in driving, torque-transmitting relation on the inserted position of said coupler in said slideway.

5. A device in accordance with claim 4 wherein said complemental stop means comprises a detent extending between said slideway and said coupler portion, said detent means being effective to lock said coupler portion in either of two axially adjusted positions relative to said slideway in one relatively rotated position of said coupler portion and slideway, and to lock said coupler portion and slideway at one axially adjusted position in the other rotated position of said coupler portion relative to said slideway.

6. A device in accordance with claim 5 wherein said interior surface of said slideway and said exterior surface of said coupler portion are non-circular and symmetrical about an axis extending through the axis of rotation of said spindle.

7. An apparatus in accordance with claim 5 wherein said detent means comprises a longitudinally spaced pair of notches on said shaft and a resilient torque member on said commutator adapted to engage said notches.

* * * * *